US012478098B2

(12) United States Patent
Zhou et al.

(10) Patent No.: US 12,478,098 B2
(45) Date of Patent: Nov. 25, 2025

(54) AEROSOL CARTRIDGE WITH AIR-LIQUID CHANNEL

(71) Applicant: ZHEJIANG MAIBO POLYMER MATERIALS CO., LTD., Zhejiang (CN)

(72) Inventors: Xingfu Zhou, Zhejiang (CN); Liping Wang, Zhejiang (CN); Ding Shen, Zhejiang (CN)

(73) Assignee: ZHEJIANG MAIBO POLYMER MATERIALS CO., LTD., Zhejiang (CN)

( * ) Notice: Subject to any disclaimer, the term of this patent is extended or adjusted under 35 U.S.C. 154(b) by 553 days.

(21) Appl. No.: 17/912,526

(22) PCT Filed: Sep. 22, 2020

(86) PCT No.: PCT/CN2020/116737
§ 371 (c)(1),
(2) Date: Sep. 19, 2022

(87) PCT Pub. No.: WO2021/143188
PCT Pub. Date: Jul. 22, 2021

(65) Prior Publication Data

US 2023/0157360 A1 May 25, 2023

(30) Foreign Application Priority Data

Jan. 17, 2020 (CN) ..... 202010050867.3

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/485* (2020.01); *A24F 40/70* (2020.01)

(58) Field of Classification Search
None
See application file for complete search history.

(56) References Cited

U.S. PATENT DOCUMENTS

2013/0160764 A1* 6/2013 Liu ..... A61M 15/06 128/202.21
2013/0228191 A1* 9/2013 Newton ..... A61M 15/06 131/329

(Continued)

FOREIGN PATENT DOCUMENTS

CN 204317503 5/2015
CN 207285194 5/2018

(Continued)

OTHER PUBLICATIONS

"International Search Report (Form PCT/ISA/210) of PCT/CN2020/116737", mailed on Dec. 23, 2020, with English translation thereof, pp. 1-4.

*Primary Examiner* — Manley L Cummins, IV
(74) *Attorney, Agent, or Firm* — Cherskov Flaynik & Gurda, LLC

(57) ABSTRACT

An aerosol cartridge with an air-liquid channel is disclosed. The aerosol cartridge includes: a liquid storage element, an atomizer and an air-liquid channel, the liquid storage element and the atomizer are communicated by the air-liquid channel, the air-liquid channel includes at least one fluid channel axially penetrating the air-liquid channel, and the air-liquid channel further includes a fluid core.

8 Claims, 9 Drawing Sheets

(51) Int. Cl.
*A24F 40/485* (2020.01)
*A24F 40/70* (2020.01)

(56) References Cited

U.S. PATENT DOCUMENTS

| | | | | |
|---|---|---|---|---|
| 2014/0109921 | A1* | 4/2014 | Chen | A24F 40/44 131/273 |
| 2015/0272216 | A1 | 10/2015 | Dai et al. | |
| 2016/0192710 | A1* | 7/2016 | Liu | A24F 40/44 131/329 |
| 2018/0077971 | A1* | 3/2018 | Katayama | A61M 15/06 |
| 2018/0132534 | A1* | 5/2018 | Reevell | A61M 15/06 |
| 2018/0242643 | A1* | 8/2018 | Silvesstrini | A24B 15/167 |
| 2021/0186104 | A1* | 6/2021 | Mironov | H05B 3/34 |
| 2023/0157360 | A1* | 5/2023 | Zhou | A24F 40/485 131/329 |

FOREIGN PATENT DOCUMENTS

| | | |
|---|---|---|
| CN | 110250576 | 9/2019 |
| CN | 209732600 | 12/2019 |

* cited by examiner

AEROSOL CARTRIDGE WITH AIR-LIQUID CHANNEL

CROSS-REFERENCE TO RELATED APPLICATION

This application is a 371 of international application of PCT application serial no. PCT/CN2020/116737, filed on Sep. 22, 2020, which claims the priority benefit of China application no. 202010050867.3, filed on Jan. 17, 2020. The entirety of each of the above-mentioned patent applications is hereby incorporated by reference herein and made a part of this specification.

TECHNICAL FIELD

The present application relates to the technical field of an aerosol cartridge with an air-liquid channel, and more particularly to an aerosol cartridge with an air-liquid channel in the application field such as liquid electric mosquito-repellent incense, electric aromatherapy, electronic cigarettes and drug solution atomization.

BACKGROUND

The technology for dissipation liquid by ultrasonic atomizing or electric heating is widely used in the field of liquid mosquito-repellent incense, aromatherapy and electronic cigarettes. In the field of liquid mosquito-repellent incense and aromatherapy, core rods are used to siphon liquid to the top, and the liquid at the top of the core rod is vaporized by heater atomizing or ultrasonic atomizing in the traditional methods. For high viscosity liquids such as essential oils, the velocity of the siphoning liquid to the top of the core rod is generally difficult to follow the atomization speed of the liquid, so this technology requires a large number of organic solvents to dilute the active ingredient with higher viscosity to increase the siphon speed of the liquid. The use of a large number of organic solvents not only wastes resources, but also harmful to human health. If the concentrated solution with higher viscosity can be directly dissipated, not only the waste of resources can be reduced, but also the device can be miniaturized, so that an aerosol cartridge with an air-liquid channel is more beautiful and more convenient to carry.

When using traditional tobacco, it has a greater impact on health when inhaling the harmful substances such as tar during tobacco burning. Electronic cigarettes employ atomization to inhale nicotine or nicotine salts, which does not produce tar. A common technology of electronic cigarettes is to heat the atomizing core which is directly connected to the cigarette oil, so that the nicotine and the solvent are atomized together. In this technology, it is prone to leak the cigarette oil due to the lack of precise control for the conducting of cigarette oil, and the consumption experience is poor.

SUMMARY

In order to solve the technical problems in the related art, the present invention discloses an aerosol cartridge with an air-liquid channel, the aerosol cartridge includes: a liquid storage element, an atomizer and an air-liquid channel. The liquid storage element and the atomizer are communicated by the air-liquid channel. The air-liquid channel comprises at least one fluid channel axially penetrating the air-liquid channel, and the air-liquid channel further comprises a fluid core.

Further, the maximum inscribed circle diameter of the smallest cross-section among the fluid channels is 0.05 mm to 1 mm.

Further, the air-liquid channel is directly communicated with the atomizer.

Further, a buffer liquid storage is provided in an atomizing chamber.

Further, the air-liquid channel is communicated with the atomizer by the buffer liquid storage.

Further, the buffer liquid storage is made of fibers or sponges.

Further, the buffer liquid storage includes a buffer liquid storage high-density portion and a buffer liquid storage low-density portion.

Further, the atomizing chamber is provided with an air-inlet hole.

Further, the aerosol cartridge includes a condensate absorbing element.

Further, the fluid core is made of fiber by bonding.

An aerosol cartridge with an air-liquid channel according to the present invention is suitable for the dissipation of various liquids, such as atomization dissipation of electronic cigarettes liquid, atomization dissipation of cannabidiol, atomization dissipation of drug solution, and is also suitable for the dissipation of the liquid from electric mosquito-repellent incense or electric aromatherapy. The aerosol cartridge with the air-liquid channel according to the present invention can uniformly control the dissipation of liquids, has a good leak-proof property, makes the structure complicated, and has a large amount of carrier liquid. These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

One or more embodiments are illustrated by way of example with reference to the pictures in the corresponding drawings, which do not constitute a limitation on the embodiments, elements having the same reference numerals in the accompanying drawings are represented as similar elements, unless specifically stated, the figures in the drawings do not constitute a proportion limitation.

DETAILED DESCRIPTION

Figure 1A:
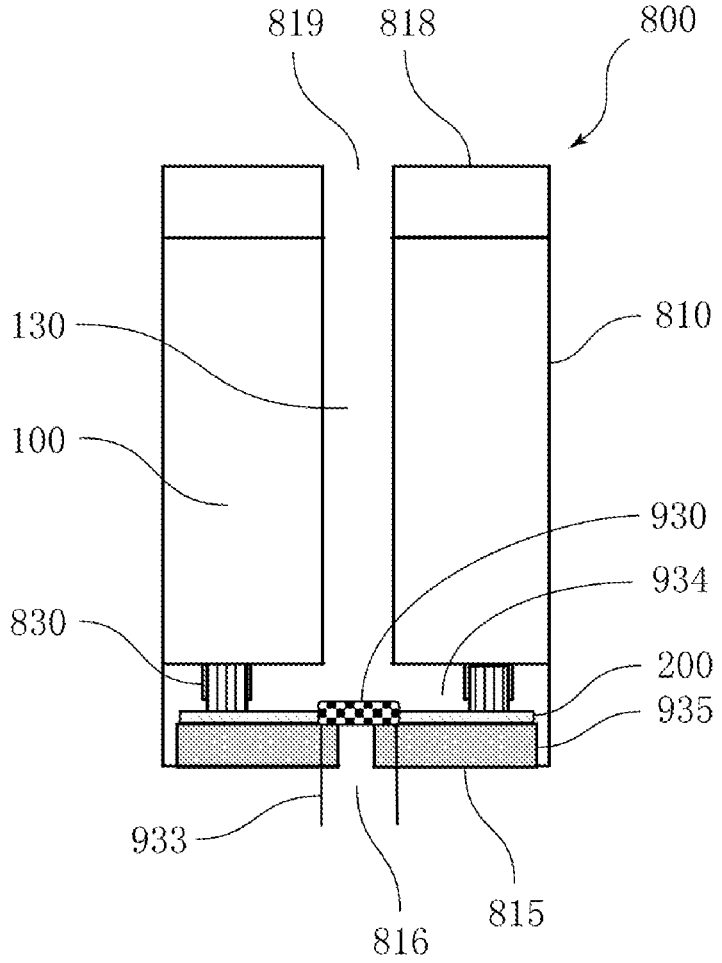
FIG. 1*a* shows a schematic structural diagram of an aerosol cartridge with an air-liquid channel according to the first embodiment of the present invention.

The embodiments of the present invention are described below by way of specific embodiments, and those skilled in the art can readily understand other advantages and functions of the present invention from the disclosure of the present invention.

Exemplary embodiments of the present invention will now be described with reference to the accompanying drawings; however, the invention may be embodied in many different forms and is not limited to the embodiments described herein, which are provided for the purpose of providing a detailed and complete disclosure of the present invention, and fully conveying the scope of the invention to those skilled in the art. The terminology shown in the exemplary embodiments in the drawings is not intended to be limiting of the present invention. In the drawings, the same elements/components generally use the same or similar reference numerals.

As used herein, the terms including scientific and technical terms have the meanings commonly understood to one skilled in the art, unless otherwise indicated. In addition, it is to be understood that a term defined in commonly used dictionaries should be understood to have a consistent meaning in the context of its associated domain and should not be interpreted as an idealized or overly formal meaning.

The First Embodiment

Figure 1B:
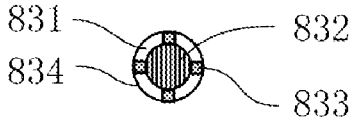
FIG. 1B shows a schematic cross-sectional view of an air-liquid channel in the aerosol cartridge with the air-liquid channel according to the first embodiment.
Figure 1C:
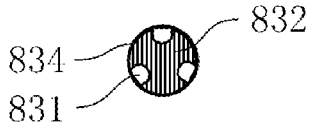
FIG. 1*c* shows another schematic cross-sectional view of the air-liquid channel in the aerosol cartridge with the air-liquid channel according to the first embodiment.

FIG. 1*a* shows a schematic structural diagram of an aerosol cartridge with an air-liquid channel according to the first embodiment of the present invention; FIG. 1B shows a schematic cross-sectional view of the air-liquid channel in the aerosol cartridge with an air-liquid channel according to the first embodiment; FIG. 1*c* shows another schematic cross-sectional view of the air-liquid channel in the aerosol cartridge with the air-liquid channel according to the first embodiment.

As shown in FIG. 1*a*, FIG. 1B and FIG. 1*c*, an aerosol cartridge with an air-liquid channel according to the first embodiment of the present invention, the aerosol cartridge 800 comprises: a liquid storage element 100, an atomizer and an air-liquid channel 830. The liquid storage element 100 is communicated with the atomizer by the air-liquid channel 830. The air-liquid channel 830 comprises at least one fluid channel 831 axially penetrating the air-liquid channel 830, and the air-liquid channel 830 further comprises a fluid core 832.

<The Liquid Storage Element>

In the aerosol cartridge 800 according to the present invention, the liquid storage element 100 is a component that store the liquid to be dissipated. Depending on the purpose of the application, the liquid storage element 100 can store different liquids, such as essential oil for aromatherapy, or mosquito repellent for liquid mosquito-repellent incense, cigarette oil for electronic cigarettes, cannabidiol solutions, or drug solution for aerosol, and the like. The liquid storage element 100 can have various cross-sectional shape, such as a circular shape, an elliptical shape, a long square shape, or the like, or may be a combination of various geometric shapes. The liquid stored in the liquid storage element 100 can be injected from the air-liquid channel, or an upper cover is provided on the liquid storage element 100, and the upper cover is closed after the liquid is filled.

The aerosol cartridge 800 further comprises an aerosol cartridge housing 810, the aerosol cartridge housing 810 is provided with a bottom plate 815 and a top plate 818, and the top plate 818 is provided with a top-plate aerosol hole 819. The liquid storage element 100 is disposed in the aerosol cartridge housing 810.

The liquid storage element 100 can have a liquid storage element through-hole 130 which axially penetrates through the liquid storage element 100. The liquid storage element through-hole 130 can be used as an aerosol channel for the aerosol cartridge 800.

The aerosol channel communicates with the atomizing chamber 934 and the top plate aerosol hole 819, and its function is to lead out the aerosol in the atomizing chamber 934 to the top plate aerosol hole 819. The aerosol channel can be integrally formed with the liquid storage element 100, the liquid storage element through-hole 130 is used as the aerosol channel and can also be assembled into the aerosol cartridge 800 which formed by plastic, metal, ceramic, glass or the like separately.

The top plate aerosol hole 819 is a component that the aerosol escapes from the aerosol cartridge 800 after the dispersed liquid is vaporized or atomized. The top plate aerosol hole 819 may be made of plastic, ceramic, or metal, or the like. The top plate aerosol hole 819 is in communication with the atomizing chamber 934 through an aerosol channel. If the application of the aerosol cartridge 800 is an electronic cigarette, an oil-absorbing cotton which is a porous material that can absorb the condensate can be arranged at the aerosol channel or the top plate aerosol hole 819. After the liquid in the electronic cigarettes is atomized, the aerosol will be partially condensed and forms a condensate when passing through the aerosol channel, the oil-absorbing cotton can absorb the condensate in the aerosol before the aerosol enters the user's mouth, thereby improving the smoking experience.

<Atomizing Unit>

An atomizing unit according to the present invention comprises the atomizing chamber 934 and the atomizer, the atomizing chamber 934 is a cavity in which the liquid is vaporized or atomized. In the present embodiment, the atomizing chamber 934 is provided at an area between the bottom of the liquid storage element 100 and the bottom plate 815. The atomizer is provided in the atomizing chamber 934 and the atomizing chamber 934 may be provided with an air-inlet hole as required, for example, a bottom plate through-hole 816 as an air-inlet hole is provided on the bottom plate 815. The liquid in the atomizing chamber 934 is vaporized or atomized by the atomizer and leads out of the aerosol cartridge 800 via the liquid storage element through-hole 130 and the top plate aerosol hole 819.

The atomizer of the present invention generally refers to components that can vaporize or atomize the liquid according to application requirements. The atomizer comprises a heating core 930, such as a heating wire wound with glass fiber or cotton, a porous ceramic pre-embedded with a heating wire, a ceramic printed with a thick film heater, and the like. The atomizer may further comprise a wicking element 200, such as glass fiber or cotton wound by a heating wire, non-woven fabric wrapping in the porous ceramic of the pre-embedded heating wire, and the like.

The atomizer further comprises a wire 933, and the atomizer is connected to a power source (not shown) via the wire 933.

The atomizer may take the form of electric heating: for example, the heating wire is wound with glass fiber or cotton rope, or cotton or cotton non-woven fabric is wound on the heating wire, or the heating wire is pre-embedded in the ceramic, or a thick film heater is printed on the ceramic surface, or a positive temperature coefficient ceramic heater is used; or an ultrasonic atomizer or other types of atomizers may be used. Depending on the application requirements, the atomizer can be made in various shapes suitable for assembly.

A supporting member 935 may be provided at the bottom of the atomizing chamber 934, and the supporting member 935 can be made of a material such as silica gel to strengthen the contact communication between the air-liquid channel 830 and the atomizer.

Liquid leakage occurs due to the abnormal conditions of the aerosol cartridge 800 during storage, transportation or use. The support component 935 may be designed to be made of a material with both buffering and liquid storage functions, while the atomizing chamber 934 may also be designed to store part of the liquid, which can accommodate the liquid conducted from the liquid storage element 100, thereby avoiding the leakage of the liquid to the outside.

When necessary, a buffer liquid storage (not shown) may be provided in the atomizing chamber 934, the air-liquid channel 830 and the atomizer may be respectively in communication with the buffer liquid storage. The buffer liquid storage may store part of the liquid conducted from the liquid storage element 100, and also conduct the liquid between the air-liquid channel 830 and the atomizer. When abnormal conditions occur during storage, transportation or usage of the aerosol cartridge 800, the buffer liquid storage can absorb the liquid conducted from the liquid storage element 100, thereby reducing the risk of liquid leakage to the outside. The supporting member 935 and the buffer liquid storage may be made of fibers, and the fibers may be natural fibers such as cotton, or modified products of natural fibers such as cellulose acetate fibers and may also be synthetic fibers such as polyester fibers, polylactic acid fibers, sheath-core structure polyethylene/polypropylene bicomponent fibers, and the like. The fibers may be bonded to the buffer liquid storage with a desired shape, which facilitating the buffer liquid storage to assemble into the aerosol cartridge 800. In addition, the supporting member 935 and the buffer liquid storage can also be made of sponge, such as polyurethane sponge, polyvinyl alcohol sponge, and the like. The buffer liquid storage may be provided with a high-density portion and a low-density portion, so as to better control the conduction of the liquid from the liquid storage element 100 and improve the liquid leak-proof capability.

<Air-Liquid Channel>

In the present embodiment, the liquid storage element 100 is communicated with the atomizer by the air-liquid channel 830. As shown in FIG. 1B and FIG. 1*c*, the air-liquid channel 830 includes at least one fluid channels 831 axially penetrating the air-liquid channel 830, and the air-liquid channel 830 further includes a fluid core 832. The air-liquid channel 830 is provided in the atomizing chamber 934.

One structure of the air-liquid channel 830 is shown in FIG. 1B. this air-liquid channel 830 includes an air-liquid channel outer tube 834, a fluid core 832 provided in the air-liquid channel outer tube 834, an air-liquid channel reinforcing rib 833 provided between the air-liquid channel outer tube 834 and the fluid core 832, and fluid channels 831 separated by the air-liquid channel reinforcing rib 833.

Another structure of the air-liquid channel 830 is shown in FIG. 1*c*. This air-liquid channel 830 includes an air-liquid channel outer tube 834, a fluid core 832 provided in the air-liquid channel outer tube 834, and fluid channels 831. The air-liquid channel outer tube 834 is closely matched with the fluid core 832, and a plurality of grooves axially penetrating the air-liquid channel 830 are formed on the outer peripheral portion of the fluid core 832, the grooves together with the air-liquid channel outer tube 834 form the fluid channels 831.

The fluid channels 831 can be used as air channels or liquid channels, at least one of the fluid channels 831 is used as an air channel. In an equilibrium state, the fluid core 832 absorbs sufficient liquid, and the liquid on the peripheral surface of the fluid core 832 will seal the air channel. When the liquid is conducted from the liquid storage element 100, the vacuum degree in the liquid storage element 100 is increased, the liquid that seals the air channel is absorbed by the fluid core 832, the liquid sealing of some or all of the fluid channels 831 disappears, the air in the atomizing chamber 934 enters into the liquid storage element 100 through the air channel, and when the vacuum degree in the liquid storage element 100 is reduced to the equilibrium state, the air channel is re-sealed by the liquid.

The maximum inscribed circle diameter of the smallest cross-section among the fluid channels 831 is 0.05 mm to 1 mm, and "mm" herein refers to millimeters. When the fluid channel 831 with a smaller inscribed circle diameter is used as the air channel, the liquid sealing capability is stronger, and it is suitable for applications with lower viscosity and smaller liquid outlet. When the fluid channel 831 with a larger inscribed circle diameter is used as the air channel, the liquid sealing capability is weaker, and it is suitable for applications with higher viscosity or larger liquid outlet. Depending on the nature of the liquid and application requirements, the maximum inscribed circle diameter of the smallest cross-section among the fluid channels 831 is 0.05 mm to 1 mm, such as 0.05 mm, 0.08 mm, 0.2 mm, 0.5 mm, 0.6 mm, 0.8 mm, 1 mm. In the equilibrium state, the air channel is sealed by the liquid on the peripheral surface of the fluid core 832 due to capillary forces.

The air-liquid channel 830 may be directly communicated with the atomizer, or the atomizer is indirectly communicated with the air-liquid channel through the buffer liquid storage, so that the liquid is transferred from the liquid storage element 100 to the atomizer through the air-liquid channel. In general, the fluid core 832 is used as the liquid channel, and the fluid core 832 is made of fiber by bonding, for example, bonding the polyester fibers to the fluid core 832 with a binder, or thermally bonding the bicomponent fibers to the fluid core 832, etc. In the present embodiment, the fluid core 832 may participate in constituting the air channel.

When the liquid is atomized, the liquid is continuously supplemented from the liquid storage element 100 to the atomizer or its surroundings through the air-liquid channel 830. When the external control device instructs the atomizer to work, the liquid in the atomizer is atomized, and the aerosol is leaded out of the aerosol cartridge 800 via the aerosol channel and the top-plate aerosol hole 819, meanwhile the liquid in the liquid storage element 100 is conducted and supplemented to the atomizer through the liquid channel of the air-liquid channels 830. As the liquid of conduction, when the vacuum degree in the liquid storage element 100 rises to a certain extent, the liquid sealing of the air channel of the air-liquid channels 830 is opened, the air in the atomizing chamber 934 enters into the liquid storage element 100 through the air channel, so that the vacuum degree in the liquid storage element 100 is reduced, the air channel is re-sealed by the liquid. The above process is repeatedly performed so that the atomization process can continually proceed until the liquid in the liquid storage element 100 is exhausted.

The Second Embodiment

Figure 2A:
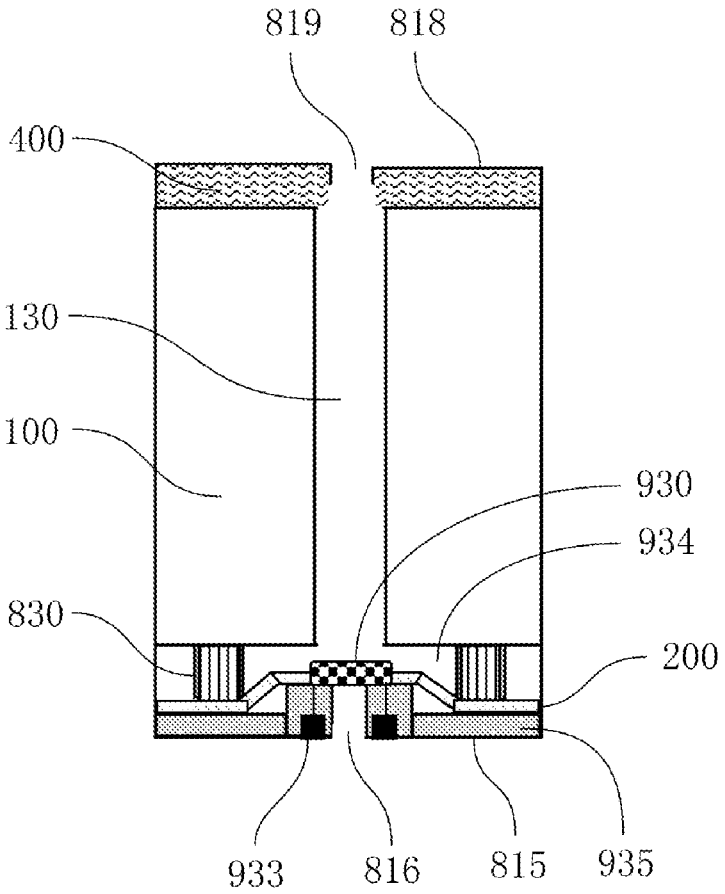
FIG. 2*a* shows a schematic structural diagram of an aerosol cartridge with an air-liquid channel according to the second embodiment of the present invention.
Figure 2B:
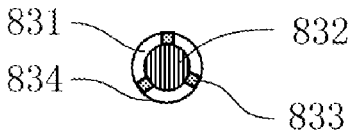
FIG. 2*b* shows a schematic cross-sectional view of an air-liquid channel in the aerosol cartridge with the air-liquid channel according to the second embodiment.
Figure 2C:
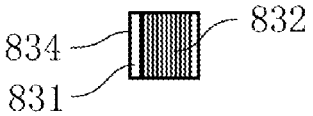
FIG. 2*c* shows a schematic profile view of the air-liquid channel in the aerosol cartridge with the air-liquid channel according to the second embodiment.

FIG. 2*a* shows a schematic structural diagram of an aerosol cartridge with an air-liquid channel according to the second embodiment of the present invention; FIG. 2*b* shows a schematic cross-sectional view of an air-liquid channel in the aerosol cartridge with the air-liquid channel according to the second embodiment; FIG. 2*c* shows a schematic profile view of the air-liquid channel in the aerosol cartridge with the air-liquid channel according to the second embodiment. The structure of the present embodiment is similar to that of the first embodiment, and the same parts as the first embodiment will not be repeated in the description of this embodiment.

In the present embodiment, the cross-section and the profile of the air-liquid channel 830 are shown in FIG. 2*b* and FIG. 2*c*, respectively. The bottom of the liquid storage element 100 is provided with a short air-liquid channel outer tube 834, the fluid core 832 is inserted into the air-liquid channel outer tube 834, three air-liquid channel reinforcing ribs 833 are provided between the fluid core 832 and the air-liquid channel outer tube 834. The inner wall of the air-liquid channel outer tube 834, the air-liquid channel reinforcing ribs 833 and the outer wall of the liquid core 832 are formed a fluid channel 831. The maximum inscribed circle diameter of the smallest cross-section of the fluid channel 831 is 0.5 mm. The fluid channel 831 can be used as an air channel, and the fluid core 832 can be used as an liquid channel.

The atomizer comprises a heating core 930 and a wicking element 200. The heating core 930 is a heating wire, and the wicking element 200 is a glass fiber bundle or a cotton rope, and the heating wire is partially wound with the glass fiber bundle or the cotton rope. The wicking element 200 is in direct contact with the air-liquid channel 830 in the atomizing chamber 934, so that the liquid can be directly conducted from the liquid storage element 100 to the wicking element 200 of the atomizer through the air-liquid channel 830.

In the present embodiment, the atomizing chamber 934 is further provided with a supporting member 935 for supporting the atomizer. After the two ends of the wicking element 200 are bent, the two ends are supported by the supporting member 935.

The aerosol cartridge 800 of the present embodiment is suitable for applications such as electronic cigarettes, and the conduction of the liquid and atomization principle is similar to that of the first embodiment, and the details will not be repeated in the description of this embodiment.

The supporting member 935 of the present embodiment is made of silica gel, and the supporting member 935 is designed to have a special shape, for example, the profile view of the supporting member 935 is two symmetrical "L" shapes, so that the atomizing chamber 934 forms "depression". When the aerosol cartridge 800 encounters an abnormal fluctuation of the external environment during storage, transportation, and usage, a small amount of liquid may be conducted from the liquid storage element 100 through the liquid channel and temporarily stored in the "depression" of the atomizing chamber 934, which will reduce the risk of liquid leakage. When the liquid in the atomizer is consumed, the liquid temporarily stored in the depression of the atomizing chamber 934 will be consumed preferentially, so that the liquid will not remain in the atomizing chamber 934.

The aerosol cartridge 800 may include a condensate absorbing element 400. In the present embodiment, as shown in FIG. 2*a*, the condensate absorbing element 400 can be provided between the top plate 818 and the liquid storage element 100, which can absorb the condensate in the aerosol, and further improve the user experience.

The aerosol cartridge 800 of the present embodiment is provided as a contacting connection end at the end of the wire 933, so that the aerosol cartridge 800 can be connected with the control device in a contact manner when in use. In order to be suitable for different liquid viscosities, surface tension and different atomization speed requirements, the maximum inscribed circle diameter of the smallest cross-section of the fluid channel 831 can be set to less than 0.5 mm, such as 0.08 mm or 0.25 mm, or greater than 0.5 mm, such as 0.8 mm or 1 mm. Meanwhile, factors such as the cross-sectional area and porosity of the fluid core 832 serving as the liquid channel can also be set to increase or reduce the liquid guiding speed. Of course, the atomization speed is also related to factors such as the size of the glass fiber bundle and heating power and the like.

The Third Embodiment

Figure 3A:
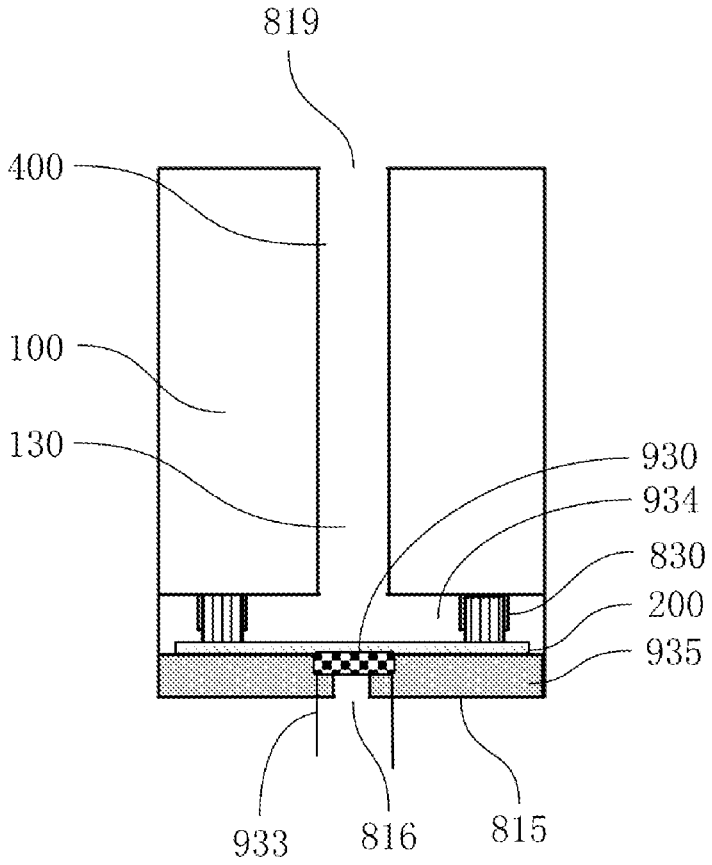
FIG. 3*a* shows a schematic structural diagram of an aerosol cartridge with an air-liquid channel according to the third embodiment of the present invention.
Figure 3B:
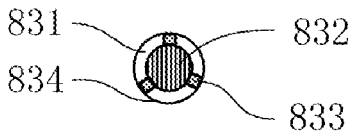
FIG. 3*b* shows a schematic cross-sectional view of an air-liquid channel in the aerosol cartridge with the air-liquid channel according to the third embodiment.

FIG. 3*a* shows a schematic structural diagram of an aerosol cartridge with an air-liquid channel according to the third embodiment of the present invention; FIG. 3*b* shows a schematic cross-sectional view of an air-liquid channel in the aerosol cartridge with the air-liquid channel according to the third embodiment. The structure of the present embodiment is similar to that of the first embodiment, and the same parts as the first embodiment will not be repeated in the description of this embodiment.

As shown in FIG. 3*a*, the atomizer of the present embodiment includes a heating core 930 and a wicking element 200, the heating core 930 is a positive temperature coefficient thermistor heater (PTC heater for short), and the wicking element 200 is made of glass fiber, cotton or polyester fibers and the like. The air-liquid channel 830 of the present embodiment is similar to that of the second embodiment, and the cross-section of that is shown in FIG. 3*b*.

If the liquid is a low-viscosity essence solution, the maximum inscribed circle diameter of the smallest cross-section of the fluid channel 831 is set to 0.05 mm; if the liquid is a higher-viscosity essential oil or mosquito repellent. etc, the maximum inscribed circle diameter of the smallest cross-section of the fluid channel 831 may be set to 0.1 mm, 0.2 mm, 0.5 mm, or even 1 mm, so that the air can smoothly enter into the liquid storage element 100 when the liquid is conducted.

The present embodiment is particularly suitable for a portable aerosol cartridge 800 such as a miniature aromatherapy and miniature liquid mosquito-repellent incense. In order to simplify the structure, the upper end of the liquid storage element 100 can be used as the top plate. The heating core 930 can also be fixed in the external control device, so as to reuse the heating core 930 and reduce the using cost.

The Fourth Embodiment

Figure 4A:
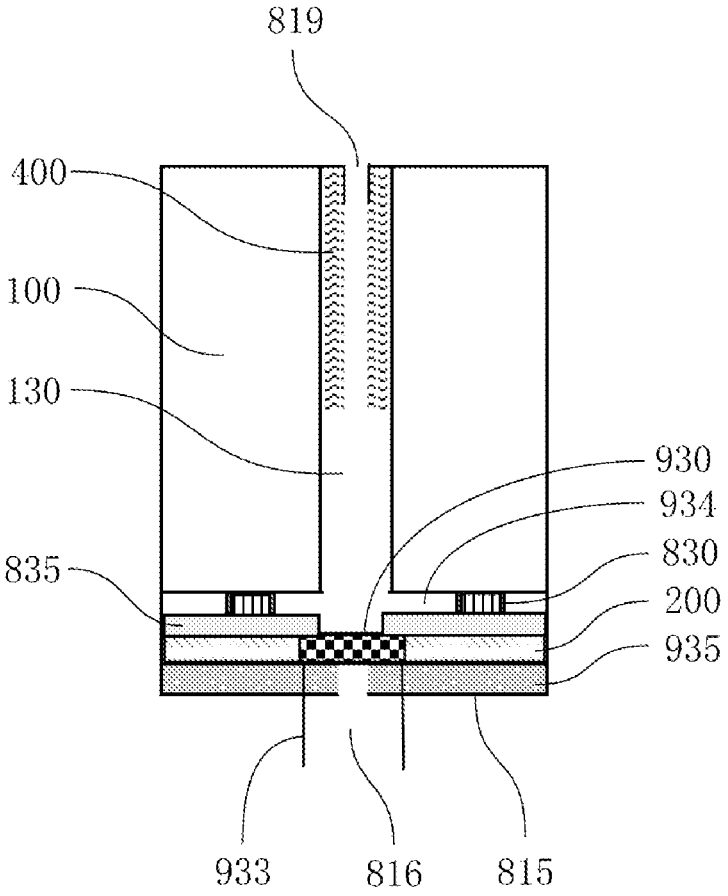
FIG. 4*a* shows a schematic structural diagram of an aerosol cartridge with an air-liquid channel according to the fourth embodiment of the present invention.
Figure 4B:
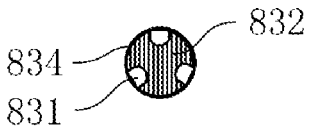
FIG. 4*b* shows a schematic cross-sectional view of an air-liquid channel in the aerosol cartridge with the air-liquid channel according to the fourth embodiment.
Figure 4C:
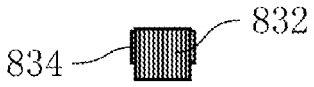
FIG. 4*c* shows a schematic profile view of the air-liquid channel in the aerosol cartridge with the air-liquid channel according to the fourth embodiment.

FIG. 4*a* shows a schematic structural diagram of an aerosol cartridge with an air-liquid channel according to the fourth embodiment of the present invention; FIG. 4*b* shows a schematic cross-sectional view of an air-liquid channel in the aerosol cartridge with the air-liquid channel according to the fourth embodiment; FIG. 4*c* shows a schematic profile view of the air-liquid channel in the aerosol cartridge with the air-liquid channel according to the fourth embodiment. The structure of the present embodiment is similar to that of the first embodiment, and the same parts as the first embodiment will not be repeated in the description of this embodiment.

As shown in FIG. 4*a* to FIG. 4*c*, a fluid core 832 with an axial groove on the outer peripheral wall is inserted into a short tube at the bottom of the liquid storage element 100 to form an air-liquid channel 830, and the short tube forms an air-liquid channel outer tube 834. As shown in FIGS. 4*b* and 4*c*, a channel formed by the groove of the fluid core 832 and the inner wall of the short tube at the bottom of the liquid storage element 100 forms a fluid channel 831, and the fluid core 832 serving as the liquid channel is made of fiber by bonding. The maximum inscribed circle diameter of the smallest cross-section of the fluid channel 831 is 0.2 mm, and if the liquid viscosity is higher, the maximum inscribed circle diameter of the smallest cross-section of the fluid channel 831 can be appropriately increased.

In the present embodiment, a buffer liquid storage 835 is provided in the atomizing chamber 934, which is made of fiber or sponge, for example, is made of polyurethane sponge or sheath-core structure polyethylene/polypropylene bicomponent fibers by bonding. The air-liquid channel 830 is in communication with the atomizer through the buffer liquid storage 835. The additional benefit brought by the buffer liquid storage 835 is that the atomizer can more stably obtain the liquid, improve the stability of the atomization, and improve the user experience. The buffer liquid storage 835 partially saturated with the liquid absorption still has partial liquid absorption performance, so that the aerosol cartridge 800 has a better leak-proof performance.

When the present embodiment is used in electronic atomization cigarettes, the advantage is that the buffer liquid storage 835 has sufficient contact with the wicking element 200. If it is rapidly atomized in a short period of time (commonly known as "taking a deep smoke"), the liquid in the buffer liquid storage 835 can be rapidly supplemented to the wicking element 200, so that the risk that the wicking element 200 of the atomizer is burnt due to temporary lack of liquid is reduced. In the present embodiment, a condensate absorbing element 400 is provided at the upper end of the aerosol channel, which is used to absorb the condensate in the aerosol and improve the use experience.

The Fifth Embodiment

Figure 5A:
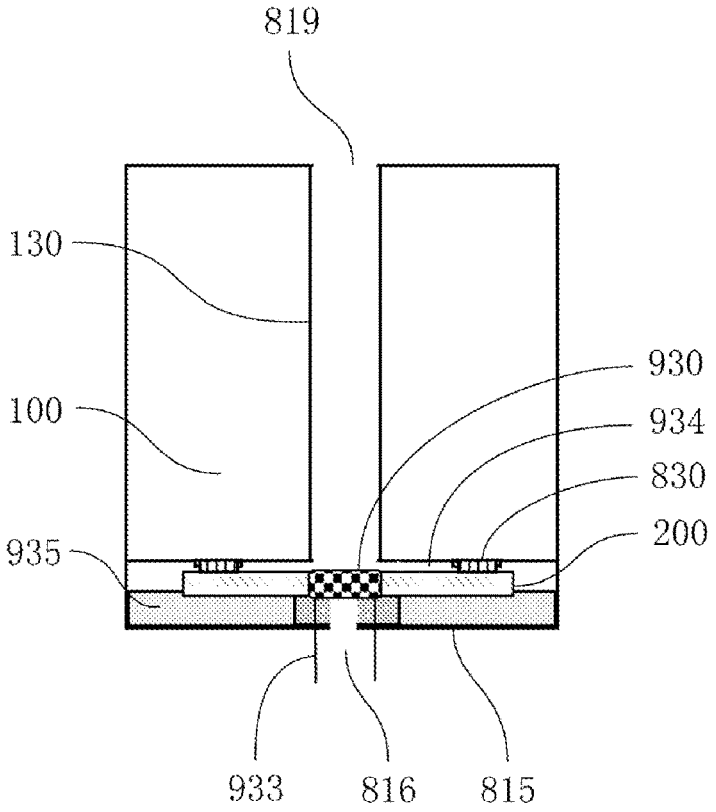
FIG. 5*a* shows a schematic structural diagram of an aerosol cartridge with an air-liquid channel according to the fifth embodiment of the present invention.
Figure 5B:
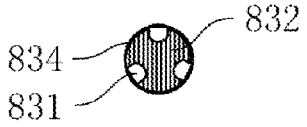
FIG. 5*b* shows a schematic cross-sectional view of an air-liquid channel in the aerosol cartridge with the air-liquid channel according to the fifth embodiment.
Figure 5C:
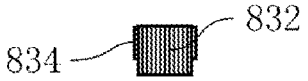
FIG. 5*c* shows a schematic profile view of the air-liquid channel in the aerosol cartridge with the air-liquid channel according to the fifth embodiment.

FIG. 5*a* shows a schematic structural diagram of an aerosol cartridge with an air-liquid channel according to the fifth embodiment of the present invention; FIG. 5*b* shows a schematic cross-sectional view of an air-liquid channel in the aerosol cartridge with the air-liquid channel according to the fifth embodiment; FIG. 5*c* shows a schematic profile view of the air-liquid channel in the aerosol cartridge with the air-liquid channel according to the fifth embodiment. The structure of the present embodiment is similar to that of the first embodiment, and the same parts as the first embodiment will not be repeated in the description of this embodiment.

As shown in FIG. 5*a*, a fluid core 832 with an axial groove on the outer peripheral wall is inserted into a short tube at the bottom of the liquid storage element 100 to form an air-liquid channel 830, and the short tube forms an air-liquid channel outer tube 834. As shown in FIGS. 5*b* and 5*c*, the fluid core 832 is a liquid channel, a channel formed by the groove of the fluid core 832 and the inner wall of the air-liquid channel outer tube 834 is a fluid channel 831, and the fluid channel 831 is used as an air channel. The maximum inscribed circle diameter of the smallest cross-section of the fluid channel 831 is 1 mm and is suitable for the atomization of high-viscosity liquids, such as the atomization of cannabidiol. If the liquid viscosity is lower, the maximum inscribed circle diameter of the smallest cross-section of the fluid channel 831 can be appropriately reduced, such as 0.8 mm or 0.6 mm. In the present embodiment, a supporting member 935 made of polyurethane sponge or cotton. etc is provided at the bottom of the atomizing chamber 934, and the supporting member 935 has the function of buffering liquid storage.

The Sixth Embodiment

Figure 6A:
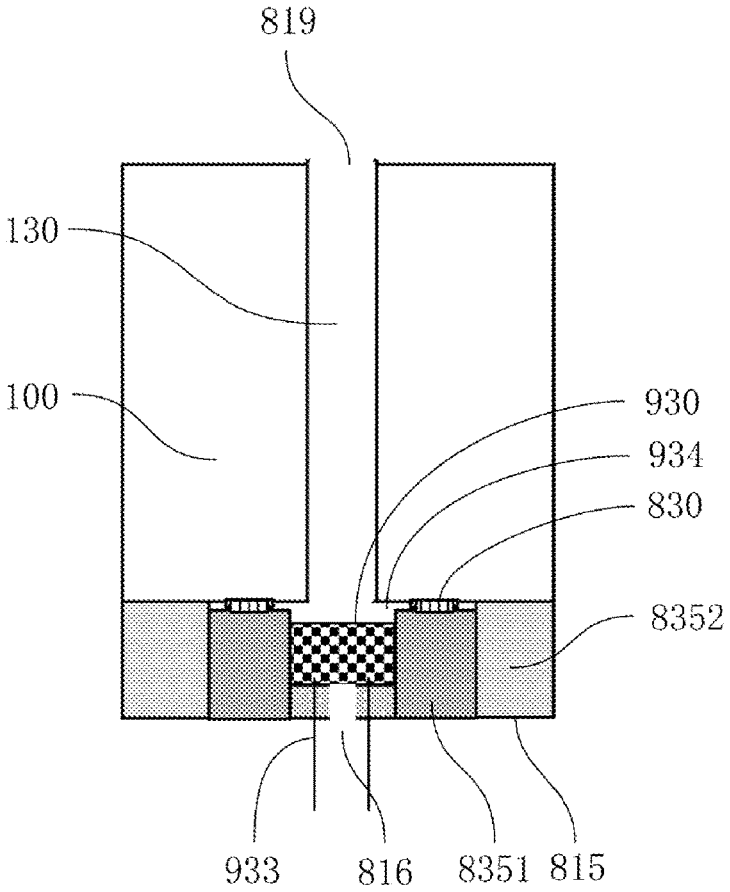
FIG. 6*a* shows a schematic structural diagram of an aerosol cartridge with an air-liquid channel according to the sixth embodiment of the present invention.
Figure 6B:
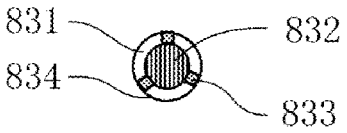
FIG. 6*b* shows a schematic cross-sectional view of an air-liquid channel in the aerosol cartridge with the air-liquid channel according to the sixth embodiment.
Figure 6C:
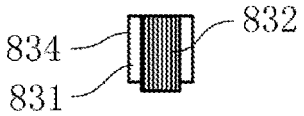
FIG. 6*c* shows a schematic profile view of the air-liquid channel in the aerosol cartridge with the air-liquid channel according to the sixth embodiment.

FIG. 6*a* shows a schematic structural diagram of an aerosol cartridge with an air-liquid channel according to the sixth embodiment of the present invention; FIG. 6*b* shows a schematic cross-sectional view of an air-liquid channel in the aerosol cartridge with the air-liquid channel according to the sixth embodiment; FIG. 6*c* shows a schematic profile view of the air-liquid channel in the aerosol cartridge with the air-liquid channel according to the sixth embodiment. The structure of the present embodiment is similar to that of the first embodiment, and the same parts as the first embodiment will not be repeated in the description of this embodiment.

The buffer liquid storage 835 may include a buffer liquid storage high-density portion 8351 and a buffer liquid storage low-density portion 8352. In the present embodiment, as shown in FIG. 6*a*, the buffer liquid storage 835 provided in the present embodiment includes a buffer liquid storage high-density portion 8351 close to the atomizer and a buffer liquid storage low-density portion 8352 located at the periphery, and a gap is provided between the buffer liquid storage high-density portion 8351 and the bottom of the liquid storage element 100. A cylindrical short tube with the air-liquid channel reinforcing rib 833 on the inner wall extends from the bottom of the liquid storage element 100, and the cylindrical short tube serves as an air-liquid channel outer tube 834, and the fluid core 832 is inserted into the air-liquid channel outer tube 834 to form an air-liquid channel 830.

As shown in FIGS. 6*b* and 6*c*, the fluid core 832 serves as the liquid channel, and a fluid channel 831 is formed among the air-liquid channel outer tube 834, the air-liquid channel reinforcing rib 833, and the fluid core 832, and the fluid channel 831 serves as the air channel. The end surface of the air-liquid channel outer tube 834 abuts against the buffer liquid storage high-density portion 8351, and the fluid core 832 is inserted into the buffer liquid storage high-density portion 8351, and the maximum inscribed circle diameter of the smallest cross-section of the fluid channel 831 is 0.8 mm.

The atomizer in this embodiment includes a heating core 930 without the wicking element, the heating core 930 is a porous ceramic pre-embedded heating wire. After the aerosol cartridge 800 is assembled, the liquid in the liquid storage element 100 is conducted to the buffer liquid storage high-density portion 8351 through the liquid channel of the air-liquid channel 830, and is further conducted to the porous ceramic. The external air enters into the liquid storage element 100 from the air channel of the air-liquid channel 830, and the capillary force of the buffer liquid storage high-density portion 8351 gradually decreases after absorbing the liquid until the liquid is no longer conducted from the liquid storage element 100, and the system reaches the balance.

Increasing or reducing the maximum inscribed circle diameter of the smallest cross-section of the fluid channel 831 may increase or reduce the amount of the liquid stored in the buffer liquid storage high-density portion 8351 when the system is balanced. When in use, the atomizer is heated, the liquid is atomized, the aerosol is leaded out to the top-plate aerosol hole 819 through the aerosol channel. The atomizer acquires the liquid from the buffer liquid storage high-density portion 8351, the amount of the liquid stored in the buffer liquid storage high-density portion 8351 is reduced, the capillary force rises, and the liquid is conducted from the liquid storage element 100 to the buffer liquid storage high-density portion 8351 through the liquid channel. This process is repeated until the liquid in the liquid storage element 100 is exhausted. If the aerosol cartridge 800 continues to be used, the liquid in the buffer liquid storage 835 will continue to conduct to the porous ceramic and atomize, but the amount of the liquid gradually decays until it cannot be used.

The present embodiment has better leak-proof performance. Because generally the buffer liquid storage low-density portion 8352 does not absorb liquid, the buffer liquid storage low-density portion 8352 can absorb excess liquid when excess liquid is conducted and exceeds the capacity of the buffer liquid storage high-density portion 8351.

The Seventh Embodiment

Figure 7A:
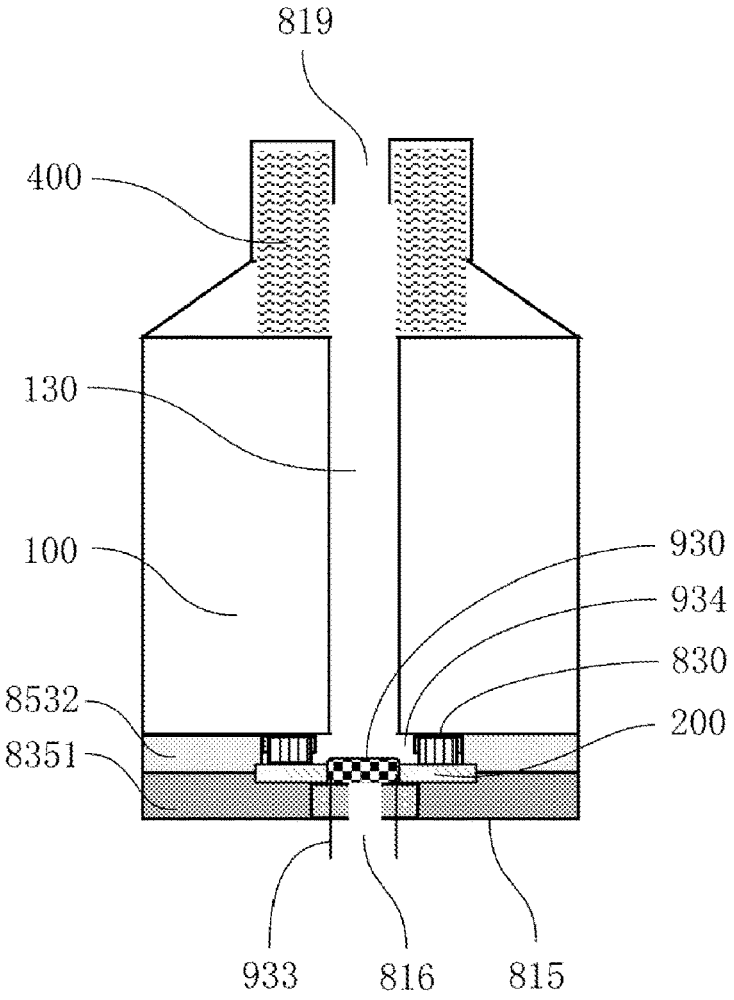
FIG. 7*a* shows a schematic structural diagram of an aerosol cartridge with an air-liquid channel according to the seventh embodiment of the present invention.
Figure 7B:
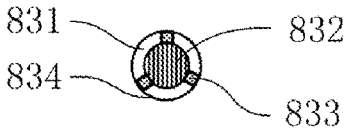
FIG. 7*b* shows a schematic cross-sectional view of an air-liquid channel in the aerosol cartridge with the air-liquid channel according to the seventh embodiment.
Figure 7C:
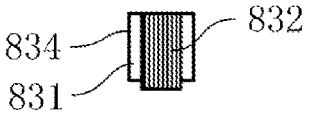
FIG. 7*c* shows a schematic profile view of the air-liquid channel in the aerosol cartridge with the air-liquid channel according to the seventh embodiment.

FIG. 7*a* shows a schematic structural diagram of an aerosol cartridge with an air-liquid channel according to the seventh embodiment of the present invention; FIG. 7*b* shows a schematic cross-sectional view of an air-liquid channel in the aerosol cartridge with the air-liquid channel according to the seventh embodiment; FIG. 7*c* shows a schematic profile view of the air-liquid channel in the aerosol cartridge with the air-liquid channel according to the seventh embodiment. The structure of the present embodiment is similar to that of the first embodiment, and the same parts as the first embodiment will not be repeated in the description of this embodiment.

As shown in FIG. 7*a*, a buffer liquid storage 835 is provided in the atomizing chamber 934 of the present embodiment, the buffer liquid storage 835 includes a buffer liquid storage low-density portion 8352 close to the liquid storage element 100 and a buffer liquid storage high-density portion 8351 located below the buffer liquid storage low-density portion 8352. A cylindrical short tube with an air-liquid channel reinforcing rib 833 on the inner wall extends from the bottom of the liquid storage element 100, and the cylindrical short tube serves as an air-liquid channel outer tube 834, and the fluid core 832 is inserted into the air-liquid channel outer tube 834 to form an air-liquid channel 830.

As shown in FIG. 7*b* and FIG. 7*c*, the fluid core 832 serves as the liquid channel, and a fluid channel 831 is formed among the air-liquid channel outer tube 834, the air-liquid channel reinforcing rib 833 and the fluid core 832, and the fluid channel 831 serves as the air channel. The maximum inscribed circle diameter of the smallest cross-section of the fluid channel 831 is 0.2 mm. The atomizer is glass fiber bundle wound on a resistance wire, and two ends of the glass fiber bundle are sandwiched between the buffer liquid storage high-density portion 8351 and the buffer liquid storage low-density portion 8352 or embedded in the buffer liquid storage high-density portion 8351. After the aerosol cartridge 800 is assembled, the liquid in the liquid storage element 100 is conducted to the wicking element 200 of the atomizer and the buffer liquid high-density portion 8351 through the liquid channel of the air-liquid channel 830, the external air enters into the liquid storage element 100 from the air channel, the capillary force of the buffer liquid storage high-density portion 8351 gradually decrease after absorbing the liquid until the liquid is no longer conducted from the liquid storage element 100, the air channel is sealed by the liquid, and the system reaches the balance.

When in use, the atomizer heats the liquid in the glass fiber bundle to atomize, and the aerosol is lead out through the aerosol channel and the top plate aerosol hole 819. During the atomization, the liquid is supplemented to the glass fiber bundle from the liquid storage element 100 through the liquid channel, and the air in the atomizing chamber 934 passes through the air channel and enters into the liquid storage element 100. The process is continuously repeated until the liquid stored in the liquid storage element 100 is exhausted. If the liquid stored in the liquid storage element 100 is a particularly viscous liquid such as glycerol, the maximum inscribed circle diameter of the smallest cross-section of the air channel can be increased to 0.3 mm or 0.5 mm, so that the liquid sealing in the air channel can be opened smoothly, so that the atomization is smoothly performed. If the liquid viscosity in the liquid storage element 100 is lower, the maximum inscribed circle diameter of the smallest cross-section of the air channel can be appropriately reduced, such as 0.1 mm, so that the air channel can obtain a suitable liquid sealing strength and prevent liquid leakage.

In the present embodiment, a condensate absorbing element 400 is provided between the top plate aerosol hole 819 and the liquid storage element 100, so as to absorb condensate in the aerosol, and improve the use experience.

The Eighth Embodiment

Figure 8A:
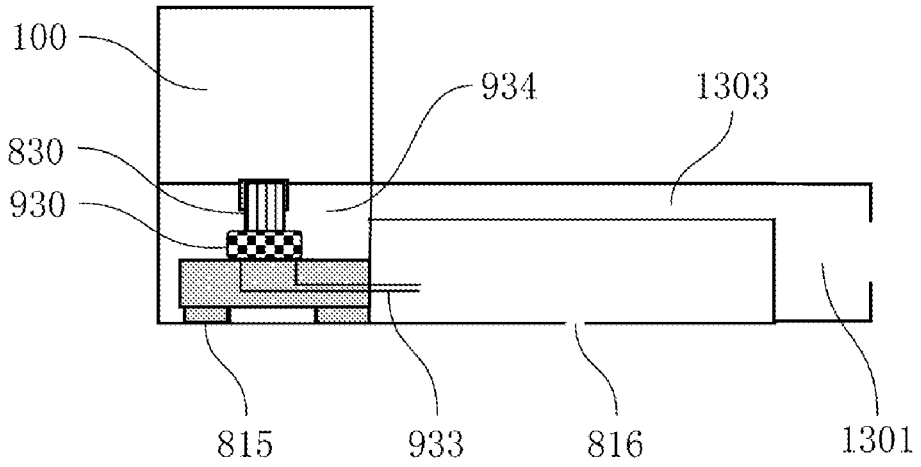
FIG. 8*a* shows a schematic structural diagram of an aerosol cartridge with an air-liquid channel according to the eighth embodiment of the present invention.
Figure 8B:
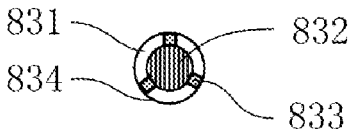
FIG. 8*b* shows a schematic cross-sectional view of an air-liquid channel in the aerosol cartridge with the air-liquid channel according to the eighth embodiment.
Figure 8C:
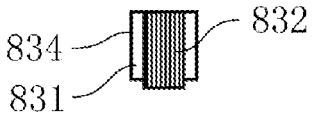
FIG. 8*c* shows a schematic profile view of the air-liquid channel in the aerosol cartridge with the air-liquid channel according to the eighth embodiment.

FIG. 8*a* shows a schematic structural diagram of an aerosol cartridge with an air-liquid channel according to the eighth embodiment of the present invention; FIG. 8*b* shows a schematic cross-sectional view of an air-liquid channel in the aerosol cartridge with the air-liquid channel according to the eighth embodiment; FIG. 8*c* shows a schematic profile view of the air-liquid channel in the aerosol cartridge with the air-liquid channel according to the eighth embodiment. The structure of the present embodiment is similar to that of the first embodiment, and the same parts as the first embodiment will not be repeated in the description of this embodiment.

As shown in FIG. 8*a*, the aerosol cartridge 800 of the present embodiment is in the shape of a pipe, and includes an aerosol channel 1303 and an aerosol outlet 1301, the aerosol channel 1303 and the aerosol outlet 1301 are provided on a side surface of the atomizing chamber 934. A cylindrical short tube with an air-liquid channel reinforcing rib 833 on the inner wall extends from the bottom of the liquid storage element 100, and the cylindrical short tube serves as an air-liquid channel outer tube 834, and the fluid core 832 is inserted into the air-liquid channel outer tube 834 to form an air-liquid channel 830.

As shown in FIG. 8*b* and FIG. 8*c*, the fluid core 832 serves as the liquid channel, and a fluid channel 831 is formed among the air-liquid channel outer tube 834, the air-liquid channel reinforcing rib 833 and the fluid core 832, and the fluid channel 831 serves as the air channel. The maximum inscribed circle diameter of the smallest cross-section of the fluid channel 831 is 0.3 mm, and the maximum inscribed circle diameter of the smallest cross-section of the fluid channel 831 can also be appropriately increased or reduced depending on the liquid viscosity and use requirements to obtain a suitable aerosol amount.

The atomizer is provided with a heating core 930 and without a wicking element, the heating core 930 is a ceramic printing with a thick film heater. The liquid in the liquid storage element 100 of the present embodiment flows through the fluid core 832 to be directly conducted to the heating core 930. When in use, the atomizer is heated, the liquid from the contact portion between the fluid core 832 and the atomizer is atomized and emitted, the liquid in the fluid core 832 is supplemented from the liquid storage element 100, the principle thereof is similar to that of the first embodiment, and the details will not be repeated herein again.

The Ninth Embodiment

Figure 9A:
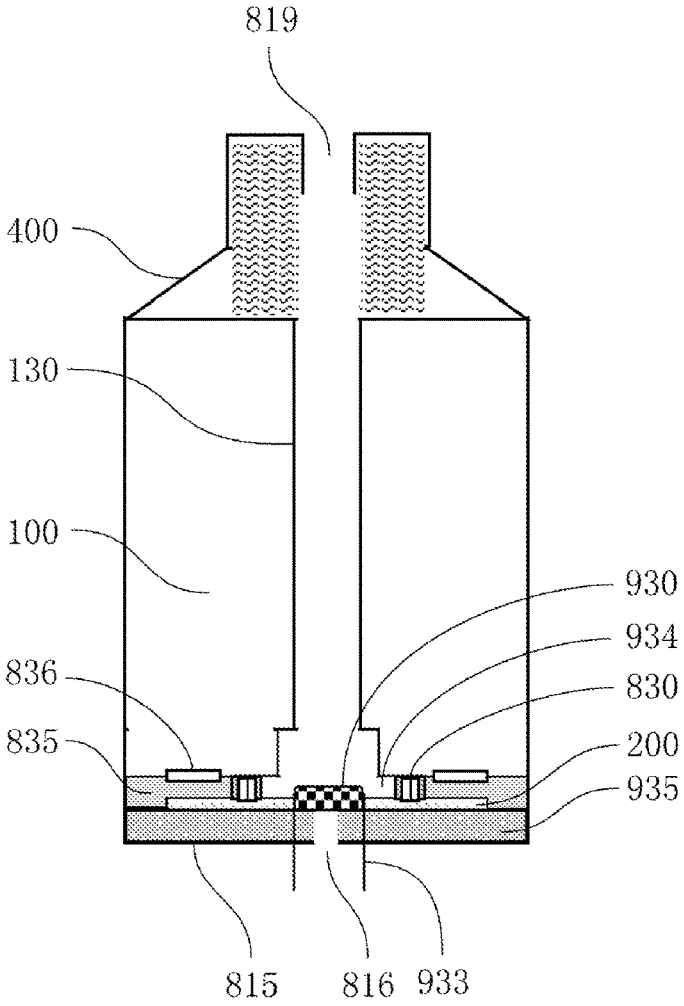
FIG. 9*a* shows a schematic structural diagram of an aerosol cartridge with an air-liquid channel according to the ninth embodiment of the present invention.
Figure 9B:
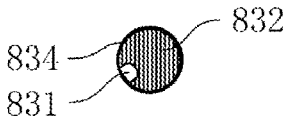
FIG. 9*b* shows a schematic cross-sectional view of an air-liquid channel in the aerosol cartridge with the air-liquid channel according to the ninth embodiment.
Figure 9C:
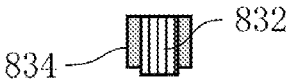
FIG. 9*c* shows a schematic profile view of the air-liquid channel in the aerosol cartridge with the air-liquid channel according to the ninth embodiment.
Figure 9D:
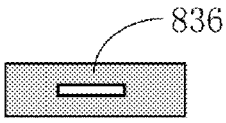
FIG. 9*d* shows a schematic cross-sectional view of a second air-liquid channel in the aerosol cartridge with the air-liquid channel according to the ninth embodiment.

FIG. 9*a* shows a schematic structural diagram of an aerosol cartridge with an air-liquid channel according to the ninth embodiment of the present invention; FIG. 9*b* shows a schematic cross-sectional view of an air-liquid channel in the aerosol cartridge with the air-liquid channel according to the ninth embodiment; FIG. 9*c* shows a schematic profile view of the air-liquid channel in the aerosol cartridge with the air-liquid channel according to the ninth embodiment; FIG. 9*d* shows a schematic cross-sectional view of an second air-liquid channel in the aerosol cartridge with the air-liquid channel according to the ninth embodiment. The structure of the present embodiment is similar to that of the first embodiment, and the same parts as the first embodiment will not be repeated in the description of this embodiment.

As shown in FIG. 9*a*, in the present embodiment, an air-liquid channel 830 is provided at the bottom of the liquid storage element 100. The air-liquid channel 830 is formed by inserting a fluid core 832 having an axial groove on the outer peripheral wall into a short tube at the bottom of the liquid storage element 100. The short tube forms an air-liquid channel outer tube 834.

As shown in FIGS. 9*b* and 9*c*, the fluid core 832 serves as the liquid channel, a fluid channel 831 is formed by the groove of the fluid core 832 and the inner wall of the air-liquid channel outer tube 834, which serves as an air channel. The maximum inscribed circle diameter of the smallest cross-section of the fluid channel 831 is 0.2 mm. Depending on the liquid viscosity, the maximum inscribed circle diameter of the smallest cross-section of the fluid channel 831 can be appropriately increased or reduced.

The bottom of the liquid storage element 100 is also provided with a second liquid channel 836, the cross-section of the second liquid channel 836 is shown in FIG. 9*d*, the second liquid channel 836 is a small groove and is in communication with the buffer liquid storage 835 provided in the atomizing chamber 934. The atomizer of this embodiment includes a heating core 930 and a wicking element 200 which is cotton or glass fiber, the heating core 930 is a heating wire wound on the wicking element 200.

The two ends of the wicking element 200 are sandwiched between the buffering liquid storage 835 and the supporting member 935 made of silica gel, and the working principle of this embodiment is similar to that of the first embodiment. The advantage of this arrangement is that the liquid conduction is more stable and reliable.

In summary, the aerosol cartridge with the air-liquid channel of the present invention is suitable for applications such as liquid mosquito-repellent incense, aromatherapy and electronic cigarettes, and can also be used in the medical field for quantitative atomization of inhaled drug solution.

This aerosol cartridge makes the structure complicated, has a good leakproof property, and is capable of uniformly controlling the emission of the liquid. If an airflow sensor is provided in the external control device, the atomization of the liquid can be controlled according to the airflow, which is more convenient to use.

In addition, the foregoing embodiments of the present invention are only intended to illustrate the principle and advantages of the present invention rather than limiting the present invention. Those skilled in the art can make modifications or changes to the foregoing embodiments without departing from the spirit and scope of the present invention. Therefore, all equivalent modifications or changes made by those skilled in the art without departing from the spirit and technical concepts disclosed by the present invention shall still be covered by the claims of the present invention.

What is claimed is:

1. An aerosol cartridge with an air-liquid channel, comprising:

a liquid storage element, an atomizer, and an air-liquid channel, wherein the liquid storage element and the atomizer are communicated by the air-liquid channel, the air-liquid channel comprises an air-liquid channel outer tube, a fluid core provided in the air-liquid channel outer tube, and fluid channels axially penetrating through the air-liquid channel, the fluid channels are provided between the air-liquid channel outer tube and the fluid core, the fluid channels are used as air channels or liquid channels, and at least one of the fluid channels is used as an air channel, the fluid core is made of fiber by bonding, a maximum inscribed circle diameter of a smallest cross-section among the fluid channels is 0.05 mm to 1 mm, and in an equilibrium state, the air channel is sealed by a liquid on a peripheral surface of the fluid core due to capillary forces.

2. The aerosol cartridge with the air-liquid channel according to claim 1, wherein the air-liquid channel is directly communicated with the atomizer.

3. The aerosol cartridge with the air-liquid channel according to claim 1, wherein the aerosol cartridge comprises a condensate absorbing element.

4. The aerosol cartridge with the air-liquid channel according to claim 1, wherein the aerosol cartridge with the air-liquid channel further comprises an atomizing chamber, and the atomizing chamber is provided with a buffer liquid storage.

5. The aerosol cartridge with the air-liquid channel according to claim 4, wherein the air-liquid channel is in communication with the atomizer by the buffer liquid storage.

6. The aerosol cartridge with the air-liquid channel according to claim 4, wherein the buffer liquid storage is made of fiber or sponge.

7. The aerosol cartridge with the air-liquid channel according to claim 4, wherein the buffer liquid storage comprises a buffer liquid storage high-density portion and a buffer liquid storage low-density portion.

8. The aerosol cartridge with the air-liquid channel according to claim 4, wherein the atomizing chamber is provided with an air-inlet hole.

* * * * *